US005163402A

United States Patent [19]

Taguchi et al.

[11] Patent Number: 5,163,402

[45] Date of Patent: Nov. 17, 1992

[54] THROTTLE CONTROL APPARATUS

[75] Inventors: Yoshinori Taguchi, Kariya; Yukihisa Oda, Chiryu; Tokihiko Akita, Toyoake; Masaru Shimizu, Toyota; Toru Fujikawa, Obu, all of Japan

[73] Assignee: Aisin Seiki Kabushiki Kaisha, Kariya, Japan

[21] Appl. No.: 813,503

[22] Filed: Dec. 26, 1991

[30] Foreign Application Priority Data

Dec. 27, 1990 [JP] Japan ..... 2-416378

[51] Int. Cl.[5] ..... F02D 7/00

[52] U.S. Cl. ..... 123/396; 123/361; 123/399

[58] Field of Search ..... 123/396, 361, 399

[56] References Cited

U.S. PATENT DOCUMENTS

| | | | |
|---|---|---|---|
| 4,120,373 | 10/1978 | Fleischer | 123/399 |
| 4,424,785 | 1/1984 | Ishida et al. | 123/399 |
| 4,445,603 | 5/1984 | Filsinger | 123/361 |
| 4,523,565 | 6/1985 | Omitsa | 123/399 |
| 5,048,484 | 9/1991 | Terazawa et al. | 123/361 |

FOREIGN PATENT DOCUMENTS

| | | | |
|---|---|---|---|
| 55-145867 | 11/1980 | Japan | 123/396 |
| 59-153945 | 9/1984 | Japan | 123/396 |
| 2-204642 | 8/1990 | Japan | 123/396 |

*Primary Examiner*—Raymond A. Nelli

*Attorney, Agent, or Firm*—Burns, Doane, Swecker & Mathis

[57] ABSTRACT

A throttle control apparatus includes an accelerator operation mechanism, a throttle shaft, a driving source, an electromagnetic clutch mechanism, driving control means, accelerator operational amount detecting means, accelerator abnormality detecting means, throttle valve opening amount detecting means, throttle abnormality detecting means, valve abnormality detecting means and clutch control means. The accelerator abnormality detecting means judge the abnormality of the accelerator operational amount detecting means and the throttle abnormality detecting means judge the abnormality of the throttle valve opening amount detecting means. Furthermore, the valve abnormality detecting means judge the operation of the throttle control as abnormality when the amount of the throttle valve opening is more than a prescribed value under the condition which the operational amount of the accelerator operation amount is less than a prescribed value. As a result of abnormality judgments of these three kinds, when at least one of them is judged as abnormality, the electromagnetic clutch mechanism is driven by the clutch control means so as to separate the driving source from the throttle shaft.

3 Claims, 10 Drawing Sheets

THROTTLE CONTROL APPARATUS

BACKGROUND OF THE INVENTION

1. Field of the Invention

The present invention relates to a throttle control apparatus installed on an internal combustion engine, and more particularly to a throttle control apparatus for controlling the opening and closing action of a throttle valve by a driving source such as a motor and so on in response to an operation of an accelerator and for being able to perform various controls such as a constant speed driving control.

2. Description of the Prior Art

In an internal combustion engine which is provided with a carburetor, a throttle valve controls a mixed gas of air and fuel and in an internal combustion engine which is provided with an electrically controlled fuel injection apparatus, a throttle valve controls the generating power of the internal combustion engine by adjusting the intake air flow. These throttle valves are constituted so as to link with an accelerator operation mechanism including an accelerator.

In recent years, apparatuses each of which is set to open and close the throttle valve by a driving source such as a motor in response to an operation of an accelerator are proposed in contrast to the above prior art in which the accelerator operation mechanism is mechanically connected with the throttle valve. An apparatus which drives a stepping motor connected with the throttle valve in response to an operation of an accelerator is disclosed, for example, in Japanese patent application laid-open publication No. 55(1980)-145867.

On the contrary, a prior measure example against the condition under which the control of an electronic controlled actuator for driving the above stepping motor is impracticable is enumerated in Japanese patent application laid-open publication No. 59(1984)-153945. For example, a throttle shaft is set to be separated from the electronic actuator by an electromagnetic clutch for closing the throttle valve by a return spring. In this prior art, however, there is not a drive means which opens-closes the throttle valve after the malfunction of control of the electronic controlled actuator stopped and therefore there is a drawback that the vehicle can't be transfered to the suitable place for repairing. Therefore, an apparatus which overcomes the above drawback is disclosed in the Japanese patent application laid-open publication No. 59(1984)-153945.

Namely, this apparatus includes an electromagnetic clutch interposed between the throttle shaft and a rotating shaft rotated by a depression of the accelerator and arranged so as to separate both shafts from each other in its exciting condition and to connect both shafts each other in its nonexciting condition and a control circuit for detecting abnormalities of operations of the electronic controlled actuator and for stopping the supply of an electric source to the electrically controlled actuator and the electromagnetic clutch by a relay. In this apparatus, the throttle shaft is mechanically connected with the accelerator via the electromagnetic clutch when the control of the electronic controlled actuator became impracticable.

In the apparatus which is disclosed in the above Japanese patent application laid-open publication No. 59(1984)-153945, a condition which the control of the electronic controlled actuator became impracticable is detected by additional control circuit and this control circuit stops supplying the electric source to the electronic controlled actuator and the electromagnetic clutch. Then, the throttle shaft and the rotating shaft which is mechanically connected with the accelerator are connected with each other by the electromagnetic clutch after the control of the electronic controlled actuator is stopped. Now, even though the throttle valve is directly driven by the operation of the accelerator, the throttle valve maintains a condition which is connected with the actuator. In this situation, since the driving torque is not generated in the motor under the condition under which the control of the electronic controlled actuator stops, the open-close operation of the throttle valve is obtained with out hindrance in response to the operation of the accelerator.

However, the electromagnetic clutch which is used in such prior apparatus becomes large in structure and increases the cost too. Furthermore, an abnormal condition is not limited to the condition which the control of the electrically controlled actuator became impracticable and there is a possibility that the operation of the above control circuit becomes impracticable. For example, there's a possibility that the throttle valve is continued driving toward the opening position by jamming and so on. In such case, even though a switch means which is additionally provided stops supplying the electric source to the electromagnetic clutch and therefore the throttle shaft is connected with the accelerator, there is no means for driving the throttle valve toward the closing position against to tha throttle shaft which is driven by the actuator and therefore it is difficult to maintain the desired degree of the throttle valve opening.

In Japanese patent application laid-open publication No. 2(1990)-204642, a throttle control apparatus which separates a driving means from the driving source surely when the stop of the accelerator operation was detected and the excess of the then predetermined amount of the throttle valve opening was detected is proposed therein. Namely, the throttle control apparatus which can stop controlling the throttle valve by the driving source when the above conditions are detected is disclosed.

In the throttle control apparatus which is disclosed in the above Japanese patent application laid-open publication No. 2(1990)-204642, however, when the accelerator operation is released and the accelerator operation mechanism returns to the stopping position speedily, the driving means of the throttle valve is not able to follow this action. Accordingly, a condition which the throttle valve exceeds the predetermined amount of the throttle valve opening when the accelerator operation mechanism became less than the predetermined operation amount is generated. Thereby, the stop of the accelerator operation is detected and the excess of the predetermined amount of the throttle valve opening at the stopping condition is detected. As a result, the driving means is separated from the throttle valve as mentioned above and therefore the throttle control of the driving source is stopped.

In the case of a structure which the driving source is comprised of the stepping motor and which the throttle valve is driven via a reduction gear mechanism by the stepping motor, for example, it is difficult to supply a driving pulse rate enough for being able to follow the return action with the stepping motor when the accelerator operation mechanism is speedily returned to the stopping position (for example, when the accelerator is released). Thereby, in spite of the normal condition, the drive of the throttle valve of the stepping motor is stopped once. On the contrary, it is not impossible to constitute the throttle control apparatus so as to follow the above action, but it is necessary to enlarge the size of the motor and to increase the supply electric current and therefore there is no practicality.

As to such an operation, since the drive of the throttle valve resumes by the driving source when the operation of the accelerator is resumed, there is no hinderance as the throttle control. Since the useless intermittence of the electromagnetic clutch is performed, however, there's a possibility that the durability of the electromagnetic clutch and parts related to that is harmed. Furthermore, it is desirable to stop controlling the throttle valve by the driving source when a means for detecting an operation amount of the accelerator or a means for detecting an amount of the throttle valve opening broke down.

SUMMARY OF THE INVENTION

It is, therefore, an object of the present invention to provide an improved throttle control apparatus which overcomes drawbacks of the above prior arts.

It is another object of the present invention to provide an improved throttle control apparatus which can separate the driving source from the throttle shaft surely when either an abnormality of a means for detecting an operation amount of the accelerator or an abnormality of a means for detecting an amount of the throttle valve opening is detected and when an abnormality of the operation of the throttle control is detected and which can stop controlling the throttle valve by the driving source at the same time.

In order to achieve these objects, there is provided an improved throttle control apparatus includes an accelerator operation mechanism, a throttle shaft fixing a throttle valve of an internal combustion engine thereto and supported on a housing so as to be able to rotate, a driving source generating driving force in response to at least an operational amount of the accelerator operation mechanism and being able to drive the throttle schaft in the direction of opening and closing of the throttle valve, an electromagnetic clutch mechanism intermitting a connection between the throttle shaft and the driving source, driving control means for controlling the electromagnetic clutch mechanism intermittently and for controlling the drive of the driving source in response to at least the operation of the accelerator operation mechanism, accelerator operational amount detecting means for generating an output signal in response to the operation amount of the accelerator operation mechanism, accelerator abnormality detecting means for judging the operational condition of the accelerator operational amount detecting means on the basis of the output signal of the accelerator operational amount detecting means and for generating an accelerator abnormal signal when the abnormality of the accelerator operational amount detecting means is detected, throttle valve opening amount detecting means for generating an output signal in response to the amount of the throttle valve opening, throttle abnormality detecting means for judging the operational condition of the throttle valve opening amount detecting means on the basis of the output signal of the throttle valve opening amount detecting means and for generating a throttle abnormal signal when the abnormality of the throttle valve opening amount detecting means is detected, valve abnormality detecting means for judging the operational condition of the throttle valve in response to the output signals of the accelerator operational amount detecting means and the throttle opening amount detecting means and for generating a valve abnormal signal when the abnormality of the throttle valve is detected and clutch control means for driving the electromagnetic clutch mechanism in response to each output signal of the valve abnormality detecting means, the throttle abnormality detecting means and the accelerator abnormality detecting means so as to separate the driving source from the throttle shaft.

BRIEF DESCRIPTION OF THE DRAWINGS

Additional objects and advantages of the present invention will become more apparent from the following detailed description of preferred embodiment thereof when considered with reference to the attached drawings, in which.

DESCRIPTION OF THE PREFERRED EMBODIMENT

Figure 1:
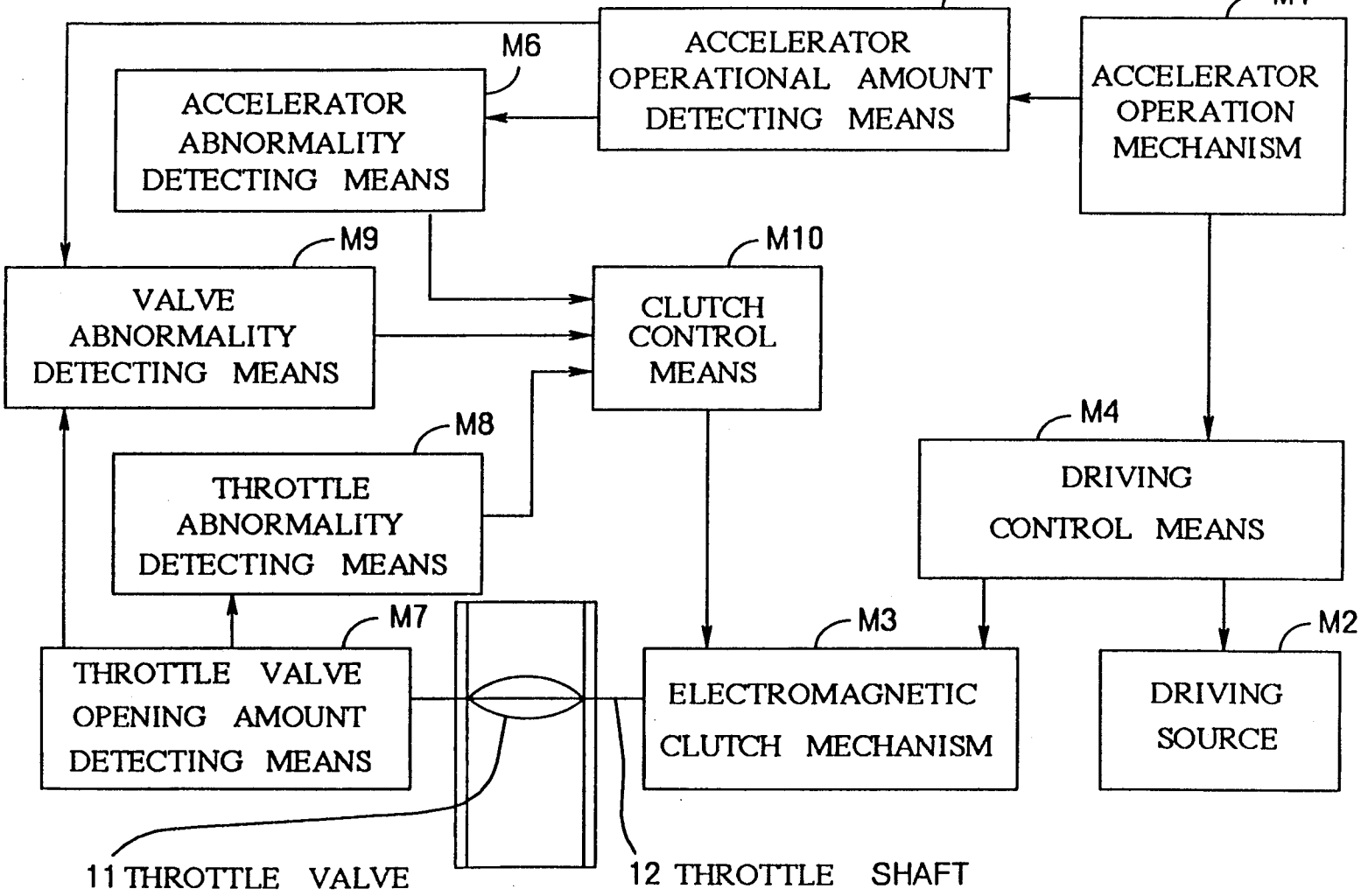
FIG. 1 is a block diagram showing a summary of a throttle control apparatus in accordance with the present invention.

A throttle control apparatus which is constituted in accordance with a preferred embodiment of the present invention will be described with reference to the drawings.

Referring to FIG. 1 to FIG. 4, a throttle valve 11 is disposed in a housing 1 which forms an intake air passage of an internal combustion engine. The throttle valve 11 is fixed to a throttle shaft 12 and the throttle shaft 12 is supported on the housing 1 so as to be able to rotate. One end of the throttle shaft 12 extends from a side of the housing 1 to the outside. At the side of the housing 1 which locates around an extending portion 12*a*, a case 2 is formed in a body and a cover 3 is united with the case 2. The principal part of parts constituting the throttle control apparatus of this embodiment is received in a space which is defined by the case 2 and the cover 3. On the other hand, at a side of the housing 1 which locates opposite to the case 2 and on which the other end of the throttle shaft 12 is supported, a cylindrical support 4 is formed on the housing 1 in a body. In the support 4, a return spring (not shown) is received and thereby the throttle shaft 12 is urged by the return spring so as to fully close the throttle valve 11.

At the top end of the throttle shaft 12, a throttle sensor 13 is connected therewith. This throttle sensor 13 transforms rotational displacements into electric signals and the throttle sensors of this kind each of which has various structures are well known. This throttle sensor 13 is provided with a variable resistance Rb and generates a throttle signal which is supplied to a controller 100 in response to the amount of the throttle valve 11 opening. Furthermore, the throttle sensor 13 is provided with an idle switch SWb which is switched in response to opening and closing condition of the throttle valve 11. Namely, the idle switch SWb becomes the OFF condition when the throttle valve opens and the idle switch SWb becomes the ON condition when the throttle valve closes fully. Accordingly, an idle-switch signal which shows a fully closed position of the throttle valve 11 is supplied to the controller 100.

Figure 2:
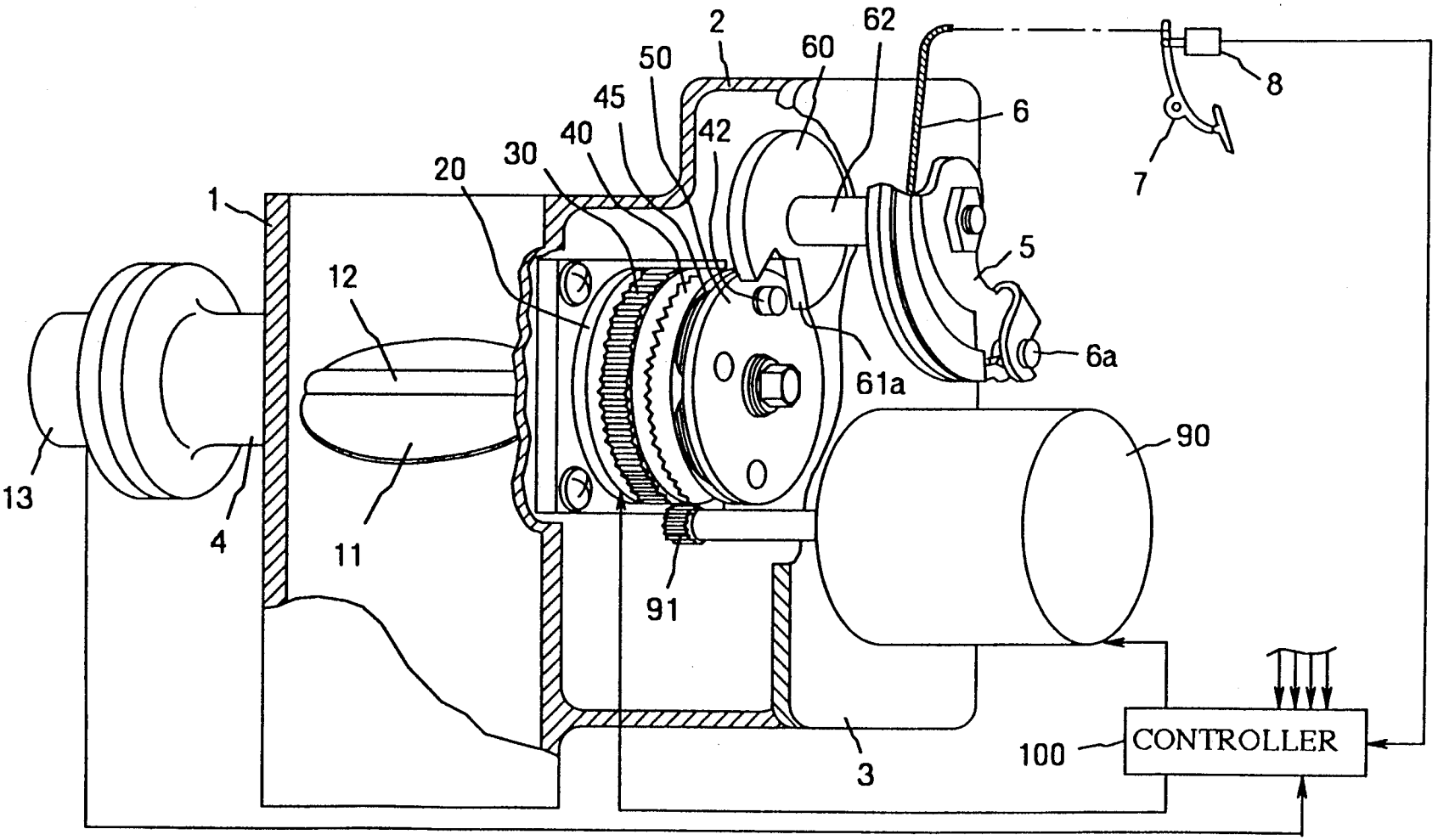
FIG. 2 is a perspective view of an embodiment of a throttle control apparatus in accordance with the present invention.
Figure 3:
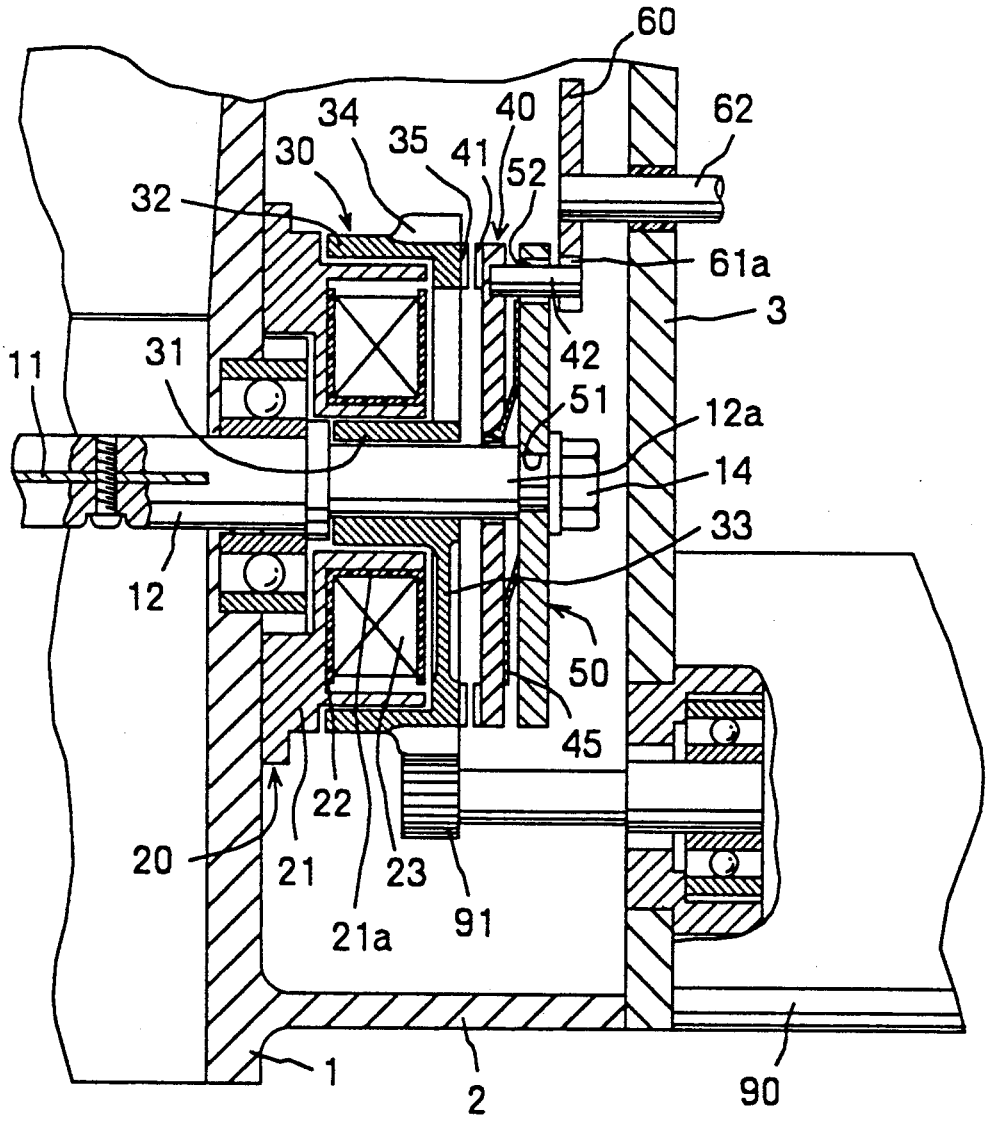
FIG. 3 is a longitudinal sectional view of an embodiment of a throttle control apparatus in accordance with the present invention.

An electromagnetic coil 20 is fixed to the side of the housing 1 so as to surround a base portion of the extending portion 12*a* of the throttle shaft 12. The electromagnetic coil 20 is provided with a yoke 21 which is made of a magnetic substance and a bobbin 22 which is made of resin as shown in FIG. 2 and FIG. 3. The yoke 21 is provided with a cylindrical portion 21*a* at its center. Around this cylindrical portion 21*a*, a circular portion is formed on the yoke 21 and the bobbin 22 and a coil 23 are disposed in the circular portion. A bottom portion of the yoke 21 is fixed to the side of the housing 1 and the extending portion 12*a* of the throttle shaft 12 penetrates into the cylindrical portion 21*a*.

Figure 4:
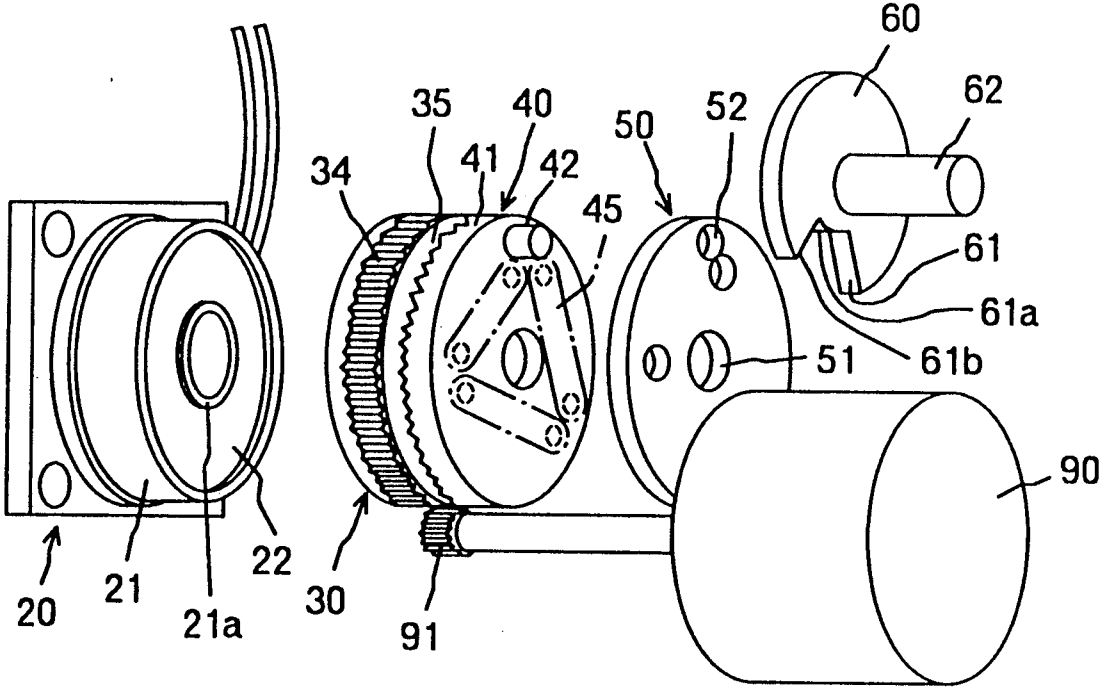
FIG. 4 is an exploded perspective view of an embodiment of a throttle control apparatus in accordance with the present invention.

Furthermore, a rotor 30 which is made of a magnetic substance is supported on the extending portion 12*a* of the throttle shaft 12 so as to be able to rotate. The rotor 30 is disposed in a prescribed position which is opposite to the yoke 21 and is held so as not to be able to move in the direction of an axis of the throttle shaft 12. As shown in FIG. 3, the rotor 30 is made of a sintered metal using mainly iron and has a shape which a cylindrical portion 32 is connected with an axial portion 31 supported on the throttle shaft 12 via arm portions 33. The axial portion 31 of the rotor 30 is fitted into the cylindrical portion 21*a* of the yoke 21 with a predetermined gap so as to overlap in the axial direction and the cylindrical portion 32 of the rotor 30 surrouds the outer side of the yoke 21. At an outer circumferential side of the cylindrical portion 32 of the rotor 30, outer teeth 34 are formed in a body. Furthermore, at a flat portion adjacent to the outer tooth 34, as shown in FIG. 3 and FIG. 4, nail portions 35 which have triangular sectional shape are continuously arranged on the whole circumference so as to radially extend and are wavily formed thereon.

Furthermore, a clutch plate 40 which has a disk-shape is supported on the throttle shaft 12 so as to confront with the rotor 30. The clutch plate 40 is able to move in the axial direction. The clutch plate 40 is made of a magnetic substance and is provided with nail portions 41 which have a same triangular sectional shape as the nail portions 35 and which are formed on the whole circumference of an its own flat portion opposite to the nail portions 35 so as to radially extend like the nail portions 35. Now, this nail portions 41 can be formed by not only machining or electrospark machining but also can be formed by press. Now, an electromagnetic clutch mechanism M3 of the present invention is consituted by the electromagnetic coil 20, the rotor 30 and the clutch plate 40.

A pin 42 is fixed to a face of the clutch plate 40 which locates opposite the face having the second nail portions 41. Furthermore, at this face of the clutch plate 40, one ends of the sheet springs 45 which are shown by a chain line in FIG. 4 are fixed thereto by pins (not shown). On the other hand, the other ends of the sheet springs 45 are fixed to a plate holder 50 mentioned later by pins (not shown). Accordingly, the clutch plate 40 is connected with the plate holder 50 via the sheet springs 45. Now, if one of the pins for fixing the sheet springs 45 is extended and is used as the pin 42 in common, it is able to reduce the number of the parts.

At a top end portion of the extending portion 12*a* of the throttle shaft 12, the plate holder 50 is fixed thereto. The plate holder 50 is provided with an oval hole 51 which is formed at its center. On the other hand, the top end portion of the extending portion 12*a* of the throttle shaft 12 is formed so as to be same sectional shape as the hole 51 and is fitted into the hole 51. Thereby, the plate holder 50 is restrained from rotating with regard to the throttle shaft 12. The top end portion of the extending portion 12*a* has a same length as thickness of the plate holder 50. A bolt (or a nut) 14 is screwed down the top end surface of the extending portion 12*a* and thereby the plate holder 50 is nipped between the bolt (or the nut) 14 and a step portion which is formed at a base portion of the top end portion of the extending portion 12*a*. Now, the hole 51 and the top end portion of the extending portion 12*a* may have, for example, a semicircular sectional shape and can be formed various shapes which restrain the plate holder 50 for rotating with regard to the throttle shaft 12.

The plate holder 50 is further provided with a hole 52 and holes. The hole 52 is formed at outer edge portion of the plate holder 50 and the pin 42 is penetrated into the hole 52. The holes are formed for caulking the sheet springs 45. Thus, when the plate holder 50 is fixed the throttle shaft 12, a top end of the pin 42 is projected from the hole 52 of the plate holder 50 as shown in FIG. 2 and FIG. 3.

Furthermore, an operation plate 60 is disposed around the pin 42 which is fixed to the clutch plate 40 so as to be opposite to the plate holder 50 at its outer edge portion. An accelerator shaft 62 is fixed to a center portion of the operation plate 60 and is supported by the cover 3 in nearly parallel with the throttle shaft 12 so as to be able to rotate. Now, the operation plate 60 is restrained from moving in the axial direction. The operation plate 60 is provided with a notch 61 which is formed at its outer edge portion so as to overlap with the pin 42. The operation plate 60 is arranged so that at least one of radial surfaces 61*a* and 61*b* can contact with side of the pin 42 is response to the rotation of the operation plate 60 in the nonexciting condition of the electromagnetic coil 20.

Figure 6:
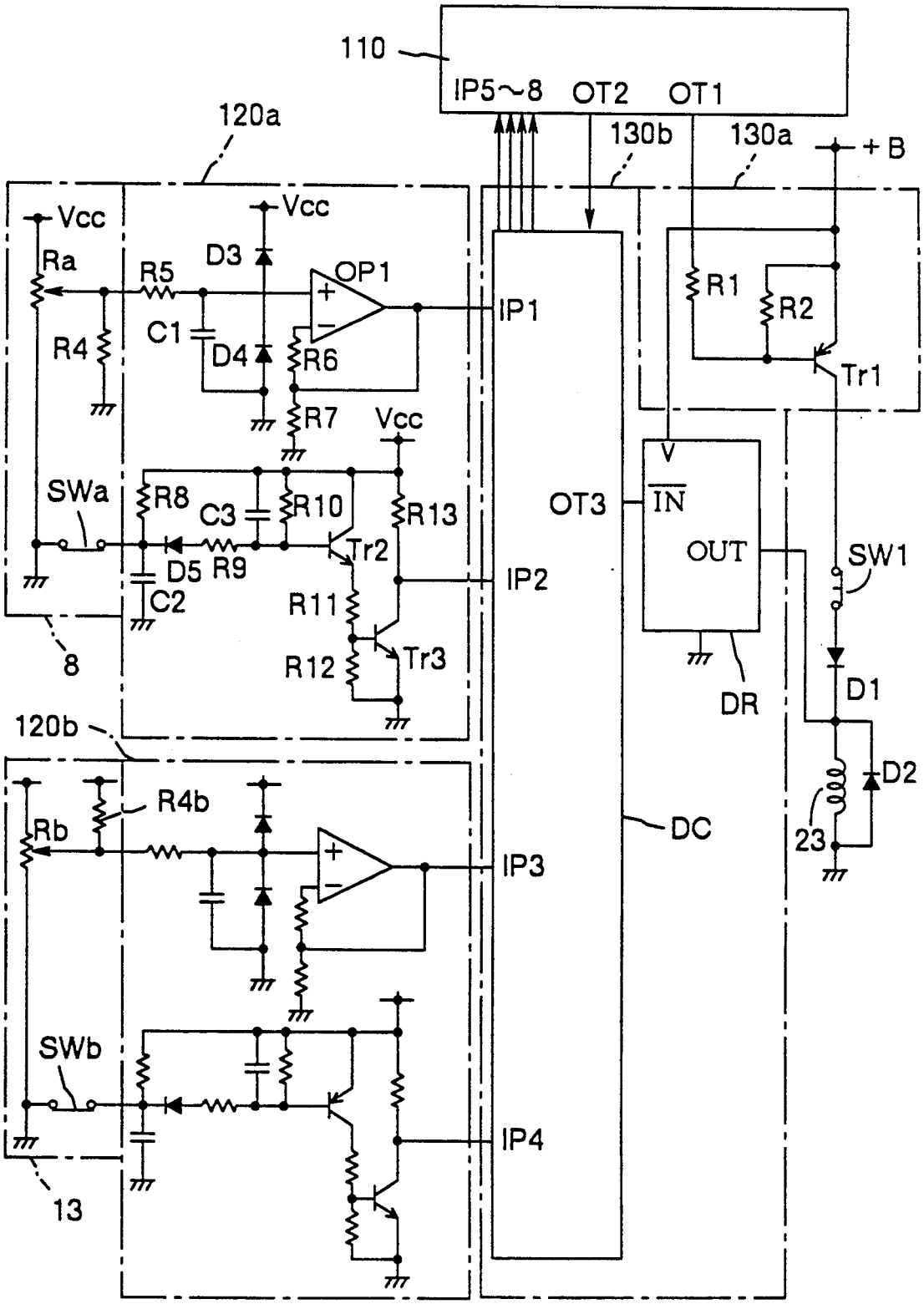

Other end of the accelerator shaft 62 is connected with an accelerator plate 5 shown in FIG. 2 by a bolt or a nut and a cable end 6*a* which is formed on one end of an accelerator cable 6 is engaged with an outer edge portion of the accelerator plate 5. The other end of the accelerator cable 6 is connected with an accelerator 7 and thereby an accelerator operation mechanism M1 by which the operation plate 60 is rotated around an axial center of the accelerator shaft 62 in response to the operation of the accelerator 7 is constituted. A well-known accelerator sensor 8 is installed on the accelerator 7. This accelerator sensor 8 is provided with a variable resistance Ra which is shown in FIG. 6 and supplies an accelerator signal corresponding to the operational amount of the accelerator 7, namely the accelerator operational amount to the controller 100. Furthermore, the accelerator sensor 8 is provided with an idle switch SWa which becomes OFF when the accelerator 7 is operated and which becomes ON when the accelerator 7 is not operated. Now, the accelerator sensor 8 may be arranged so as to link to the accelerator shaft 62.

Furthermore, a motor 90 as a driving source M2 of the present invention is fixed to the cover 3 and a rotation shaft of the motor 90 is supported in parallel with the throttle shaft 12 so as to be able to rotate. At a top end of the rotation shaft of the motor 90, a pinion gear 91 is fixed thereto and is engaged with the outer teeth 34 of the rotor 30. In this embodiment, a stepping motor is employed as the motor 90 and is driven and controlled by the controller 100. Now, it is able to apply a motor of other-type, for example, such as DC motor as the motor 90.

When the motor 90 is driven and the pinion gear 91 is rotated, the rotor 30 having the outer teeth 34 which are engaged with the pinion gear 91 is rotated around the throttle shaft 12. In this situation, if the electromagnetic coil 20 is its nonexciting condition, the clutch plate 40 is separated from the rotor 30 by the urging force of the sheet springs 45 and is located in the adjacent position to the plate holder 50. Namly, the clutch plate 40, the plate holder 50 and the throttle valve 11 can be freely rotated by the throttle shaft 12 regardless of the condition of the rotor 30. In this situation, the pin 42 which is fixed to the clutch plate 40 is located between both surfaces 61*a* and 61*b* of the notch 61 of the operation plate 60.

When the electromagnetic coil 20 is excited, a closed magnetic circuit is formed by the yoke 21, the rotor 30 and the clutch plate 40. Thereby, the clutch plate 40 is attracted toward the rotor 30 against to the urging force of the sheet springs 45 by an electromagnetic force and the nail portions 35 of the rotor 30 and the nail portions 41 of the clutch plate 40 are engaged with each other. Namely, the rotor 30 and the clutch plate 40 become an engaging condition and become a condition which are able to rotate in a body. Thereby, driving controlled variable of the motor 90 is transmitted from the pinion gear 91 to the rotor 30 via the outer teeth 34 and next is transmitted to the clutch plate 40 via the nail portions 35 and the nail portions 41. Furthermore, the driving controlled variable is transmitted from the clutch plate 40 to the plate holder 50 via the sheet springs 45 and therefore is transmitted to the throttle shaft 12 which rotates with the plate holder 50 in a body. As a result, the amount of the throttle valve 12 opening is controlled in response to the above driving controlled variable. In this situation, since the pin 42 moves with the clutch plate 40 toward the rotor 30 and does not locate between both surfaces 61*a* and 61*b* of the notch 61 of the operation plate 60, the operation plate 60 is rotated regardless of the condition of the pin 42.

When the electric current being supplied to the electromagnetic coil 20 is interrupted under the opening condition of the throttle valve 11, the engagement between the nail portions 35 of the rotor 30 and the nail portions 41 of the clutch plate 40 is released and then the throttle valve 11 is fully closed by the urging force of the return spring (not shown) which is disposed in the support 4. Thereby, the pin 42 is located between both surfaces 61*a* and 61*b* of the notch 61 of the operation plate 60. Therefore, when the operation plate 60 is operated and is rotated, the surface 61*a* is cotacted with the side of the pin 42 and the clutch plate 40 and the plate holder 50 are rotated.

Figure 5:
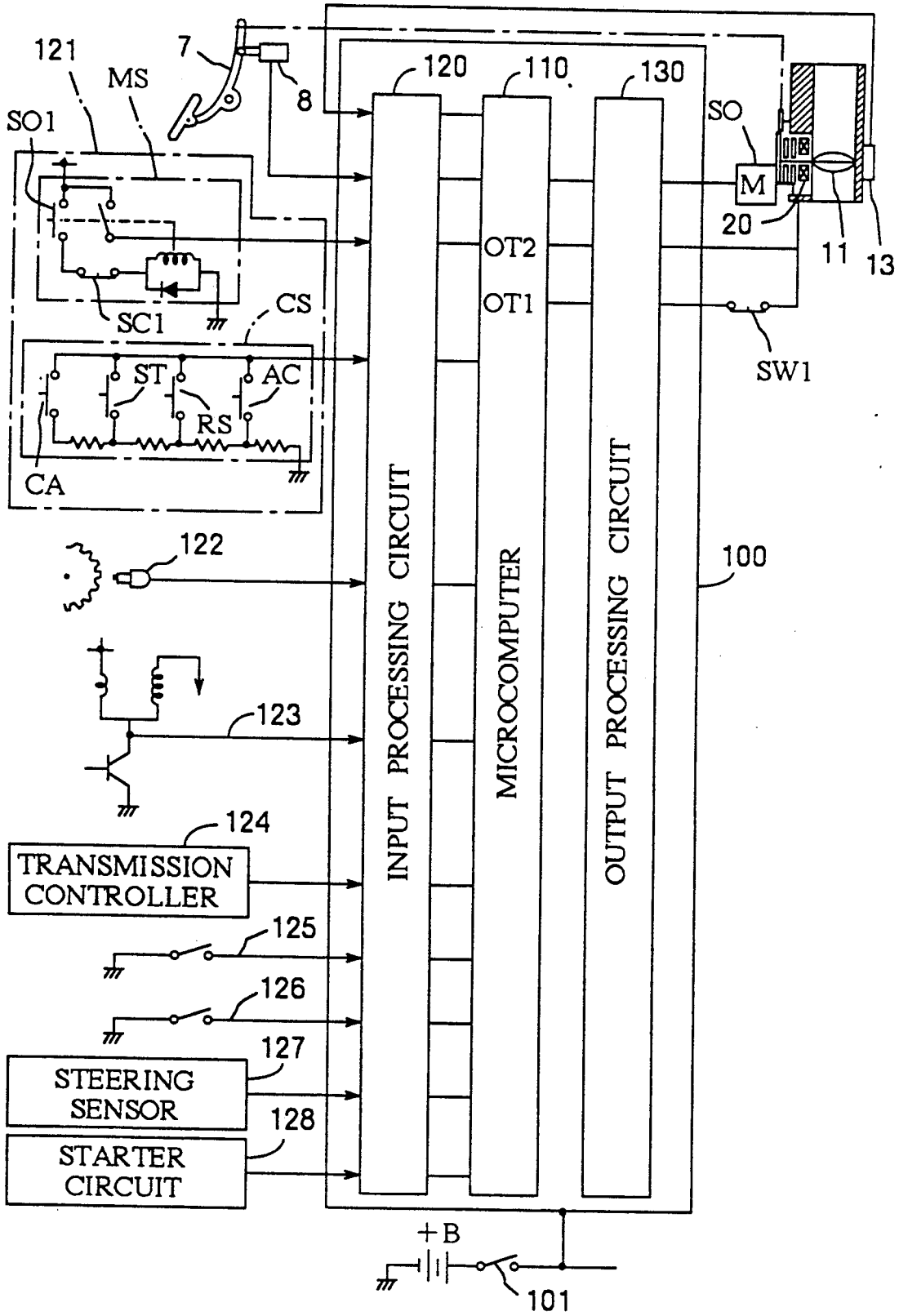
FIG. 5 is a schematic illustration of a controller and an input and output device of an embodiment of a throttle control apparatus in accordance with the present invention; and, FIG. 6 is an electric circuit diagram of input and output processing circuits which is concerned in a fuction for detecting abnormalities of an embodiment of a throttle control apparatus in accordance with the present invention.

The controller 100 as driving control means M4 of the present invention is a control circuit including microcomputer. The controller 100 is installed on the vehicle and is supplied detecting signals of various sensors as shown in FIG. 5. Thereby, various controls including the driving controls of the electromagnetic coil 20 and the motor 90 are performed by the controller 100. In this embodiment, the various controls such as a constant speed driving control, an acceleration slip control and so on are performed besides an ordinary accelerator control responding to the operation of the accelerator by the controller 100.

Referring to FIG. 5, the controller 100 is provided with a microcomputer 110, an input processing circuit 120 and an output processing circuit 130. The input processing circuit 120 and the output processing circuit 130 are connected with the microcomputer 110 and the motor 90 and the electromagnetic coil 20 are connected with the output processing circuit 130. Furthermore, the controller 100 is connected with an electric source +B via an ignition switch 101. Now, it is able to apply a transistor or a relay which turns on electricity when the ignition switch 101 is ON or other switching elements as an electric source opening-closing means of the controller 100.

The accelerator sensor 8 is connected with the input processing circuit 120 and furthermore the throttle sensor 13 is connected with the input processing circuit 120. The electromagnetic coil 20 is controlled by the controller 100 so as to exite and nonexcite in response to the driving condition of the vehicle and furthermore the driving of the motor 90 is controlled by the controller 100 so as to be able to obtain the amount of the throttle valve 12 opening which is determined in response to depressing amount of the accelerator 7, namely the accelerator operational amount and various control conditions.

A constant speed driving control switch 121 (hereinafter, a constant speed driving control switch 121 say only a constant speed driving switch 121) is connected with the input processing circuit 120. The constant speed driving switch 121 is provided with a main switch MS which controls ON and OFF of an electric source of all of a constant speed driving control system and a control switch CS which performes various controls. The control switch CS is constituted by plural groups of switches as shown in FIG. 5 and has well-known various switching functions. First of all, during the driving of the vehicle, when a set switch ST of the control switch CS is switched over ON for a short time under the condition which the main switch MS is switched over ON, the then vehicle's speed is memorized and this vehicle's speed is maintained as mentioned later. An acceleration switch AC is a switch for finely adjusting the set vehicle's speed and an acceleration control is performed during the ON condition of this acceleration switch AC. Now, the fine adjustment for reducing the vehicle's speed is performed as follows. Namely, when the set switch ST is switched over ON for a short time under the condition which the vehicle's speed is reduced to the suitable speed after the constant speed driving control is released by the hold the set switch under the ON condition or the depressing a brake pedal, the then vehicle's speed is reset. Now, there are an operation of the brake pedal, a shift to a neutral position (in case of an automatic transmission), an operation of a parking brake, an operation of the main switch MS to the OFF condition and so on as means for releasing the constant speed driving control. Furthermore, a resume switch RS is a switch for returning to the set vehicle's speed after the constant speed driving control is released by these operations.

A wheel speed sensor 122 is used for the constant speed driving control, the acceleration slip control and so on and an electromagnetic pickup sensor or hole sensor and son are applied as the wheel speed sensor 122. Now, one wheel speed sensor 122 is shown in FIG. 5, but the wheel speed sensor 122 is installed on each wheel according to demand. Furthermore, an ignition circuit unit, commonly called an igniter 123 is connected with the controller 100. Thereby, an ignition signal is supplied from the igniter 123 to the controller 100 and the number of rotations of the combustion engine is detected. A transmission controller 124 is a control device for controlling an automatic transmission and a variable speed signal and a timing signal which are generated in the transmission controller 124 are supplied to the controller 100.

Furthermore, a mode changeover switch 125, an acceleration prohibition switch 126 and a steering sensor 127 are connected with the input processing circuit 120. The mode changeover switch 125 selects one of maps which predetermined about relationships between the depressing amount of the accelerator 7 and the amount of the throttle valve 12 opening in response to various driving modes and determines the amount of the throttle valve 12 opening in response to the selected driving mode. Now, the maps are memorized in the microcomputer 110. Thereby, for example, a power mode or an economy mode, in other words, a highway driving mode or a city area driving mode is selectively determined as the driving mode. The acceleration slip control prohibition switch 126 supplies a signal for prohibiting the acceleration slip control to the microcomputer 110 when a driver does not require the acceleration slip control and operates that. The steering sensor 127 judges whether a steering (not shown) is operated or not for example when the acceleration slip control is performed and determines a target slip rate in response to the result of the judgement. Furthermore, a starter circuit 128 which controls the driving of a starting motor (not shown) is connected with the input processing circuit 120. Thereby, the starting motor is not driven until the normal functioning of the throttle control apparatus is confirmed by the practical open-close operation of the throttle valve 12 when an initial check is performed whether the throttle control apparatus functions normally or not. Therefore, it is able to avoid the excess rotation of the combustion engine when the initial check of the throttle control apparatus is performed.

Figure 7:
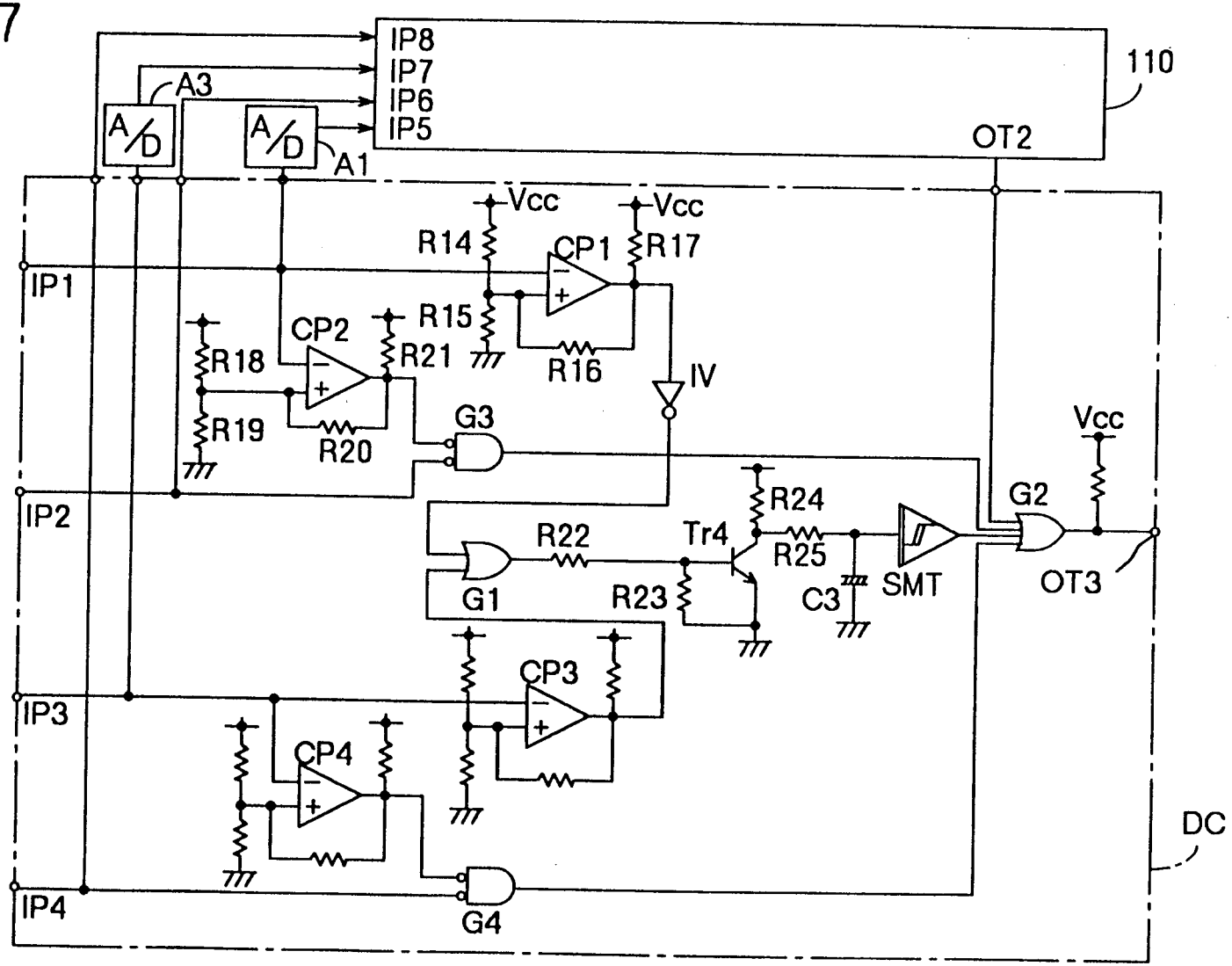
FIG. 7 is an electric circuit diagram which shows concrete structures of a judgement circuit of a throttle control apparatus in accordance with the present invention.

As shown in FIG. 6, the output processing circuit 130 is provided with a circuit 130*a* which intermitts the electromagnetic coil 20 by the output of the microcomputer 110 and ON and OFF operation of a brake switch SW1 and an electromagnetic coil control circuit 130*b* which is mentioned later. Referring to FIG. 6 and FIG. 7, hereinafter, these circuits 130*a* and 130*b* are detailed.

Referring to FIG. 6, an output port OT1 for the constant speed driving control of the microcomputer 110 is connected with a base of a PNP transistor Tr1 via a resistance R1. An emmiter of the transistor Tr1 is connected with the electric source +B and a resistance R2 is connected between the base and the emitter of the transistor Tr1. Furthermore, a collector of the transistor Tr1 is connected with coil 23 of the electromagnetic coil 20 via the brake switch SW1.

The transistor Tr1 controls the electric current being supplied to the coil 23 in the constant speed driving control and the return operation of the accelerator operation mechanism and controls the driving of the electromagnetic coil 20. Namely, in the constant speed driving control, when the main switch MS shown in FIG. 5 becomes the ON condition and the set switch ST of the constant speed driving switch 121 shown in FIG. 5 is operated, the transistor Tr1 becomes the ON condition by the microcomputer 110. Accordingly, the transistor Tr1 holds the OFF condition as far as the main switch MS does not become the ON condition and the circuit 130*a* interrupts the electric current being supplied to the coil 23.

Furthermore, a driving circuit, namely a driver DR is interposed parallel to this circuit. Namely, the driver DR is interposed between the coil 23 and the electric source +B. A port V of the driver DR is connected with the electric source +B and a driving signal is generated in an output port OUT of the driver DR when a low level (L) signal is supplied to an input port IN of the driver DR with active-low. Namely, if the throttle control apparatus is operating normally, the coil 23 and the electric source +B are held under the continuity condition each other via the driver DR. Now, diodes D1 and D2 are disposed in order to protect the transistor Tr1 and the driver DR from energy which is stored in the coil 23.

An output signal of the microcomputer 110 for controlling the electromagnetic coil 20 is supplied from an output port OT2 to a judgment circuit DC as one of input signals of an OR-gate G2 as shown in FIG. 7. An output signal of the OR-gate G2 is supplied from an output port OT3 to the input port IN of the driver DR via a resistance R3.

As shown in FIG. 6, the judgment circuit DC as accelerator abnormality detecting means M6, throttle abnormality detecting means M8, valve abnormality detecting means M9 and clutch control means M10 of the present invention is connected with the microcomputer 110 and further is connected with the throttle sensor 13 and the accelerator sensor 8. The accelerator sensor 8 detects the accelerator operational amount by a change of the value of resistance of the variable resistance Ra as a first sensor of the present invention and is constituted so as to transform this accelerator operational amount into a change of the voltage by a potentiometer. Furthermore, the accelerator sensor 8 is provided with the idle-switch SWa and functions as a accelerator operational amount detecting means M5 of the present invention. A voltage output corresponding to the accelerator operational amount is obtained by this accelerator sensor 8 and is supplied to an interface circuit 120*a* of the input processing circuit 120 via a resistance R4. Then, this voltage output of the accelerator sensor 8 is supplied to an input port IP1 of the judgment circuit DC via a low pass filter comprising a resistance R5 and a condenser C1 and a voltage follower comprising an operational amplifier OP1 and resistances R6 and R7.

The above resistance R4 is earthed and is set to the large value of resistance that the output voltage of the variable resistance Ra is not influenced. Thereby, in case of the disconnection of a wire harness which is connected with the variable resistance Ra at the worst, a signal (0) falsely showing that the throttle valve 11 positions in the fully closed position is generated and therefore the throttle control apparatus is controlled so as to determine the target amount of the throttle valve opening which shows the fully closed position of the throttle valve 11.

The idle-switch SWa as a first switch of the present invention is a switch which becomes the OFF condition when the accelerator 7 is operated and which becomes the ON condition when the the accelerator 7 is not operated. The idle-switch SWa is connected with a connection point between a resistance R8 being connected with a constant voltage electric source Vcc (hereinafter, a constant voltage electric source Vcc say only an electric source Vcc) of the interface circuit 120*a* and a condenser C2 being earthed and then is connected with a base of a PNP transistor Tr2 via a diode D5 and a resistance R9. An emitter of the transistor Tr2 is connected with the electric source Vcc and further a resistance R10 and a condenser C3 for stability are connected between the emitter and the base of the transistor Tr2. A collector of the transistor Tr2 is earthed with an emitter of a NPN transistor Tr3 via resistances R11 and R12 and a connection point between both the resistances R11 and R12 is connected with a base of the transistor Tr3. A collector of the transistor Tr3 is connected with the electric source Vcc via a resistance R13 and is connected with an input port IP2 of the judgment circuit DC.

When the accelerator 7 is operated and thereby the idle-switch SWa is in the OFF condition, both the transistors Tr2 and Tr3 are in the OFF condition. Accordingly, a high level (H) signal is supplied to the input port IP2. When the accelerator 7 is released from the operational condition and is returned to the idle position, the idle-switch SWa becomes from the OFF condition to the ON condition. Thereby, since an electric charge which is charged the condenser C2 via the resistance R8 is discharged, the transistor Tr2 becomes the ON condition and further the transistor Tr3 becomes the ON condition too. Accordingly, a low level (L) signal is supplied to the input port IP2.

The throttle sensor 13 detects the amount of the throttle valve 11 opening by a change of the value of resistance of the variable resistance Rb as a second sensor of the present invention and is constituted so as to transform this amount of the throttle valve opening into a change of the voltage by a potentiometer. Furthermore, the throttle sensor 13 as a second switch of the present invention is provided with the idle-switch SWb and functions as a throttle valve opening amount detecting means M7 of the present invention. A voltage output corresponding to the amount of the throttle valve 11 opening is obtained by this throttle sensor 13 and is supplied to an input port IP3 of the judgment circuit DC with a ON-OFF signal of the idle-switch SWb via an interface circuit 120*b* of the input processing circuit 120. Now, this interface circuit 120*b* has the same circuit structures as the interface circuit 120*a*, the explanation is omitted.

A resistance R4b is set to the large value of resistance that the output voltage of the variable resistance Rb is not influenced like the above mentioned resistance R4 and is connected with the electric source Vcc. Thereby, in case of the disconnection of a wire harness which is connected with the variable resistance Rb at the worst, a signal (Vcc) falsely showing that the throttle valve 11 positions in the fully opened position is generated and a feedback of this signal is performed. Accordingly, since the then amount of the throttle valve opening is detected as the fully opened amount, the throttle valve 11 is driven toward the closed position.

The judgment circuit DC is constituted as shown in FIG. 7. An input signal of the input port IP1 is supplied to an inverting input terminal of a comparator CP1 including resistances R14 to R17. This input signal is compared with a prescribed voltage Va1 which the voltage of the electric source Vcc is divided by the resistances R14 and R15. Now, the prescribed voltage Va1 corresponds to a value which shows a second prescribed accelerator operational amount of the present invention. An output of the result of this comparison is supplied to an OR gate G1 (hereinafter, an OR gate G1 say only a gate G1) via an inverter IV. In the same manner, the input signal of the input port IP1 is supplied to an inverting input terminal of a comparator CP2 including resistances R18 to R21 and is compared with a prescribed voltage Va2 which the voltage of the electric source Vcc is divided by the resistances R18 and R19. Now, the prescribed voltage Va2 corresponds to a value which shows a prescribed accelerator operational amount of the present invention. An output of the result of this comparison is inverted and then is supplied to an AND gate G3 (hereinafter, an AND gate G3 say only a gate G3). An input signal of the input port IP2 is inverted and then is supplied to the gate G3.

An input signal of an input port IP3 is supplied to an inverting input terminal of a comparator CP3 having the same structures as the above comparater CP2 and is compared with a prescribed voltage Vb1 as a value which shows a second prescribed amount of the throttle valve opening of the present invention. Then, an output of the result of this comparison is supplied to the gate G1. On the other hand, the input signal of the input port IP3 is supplied to an inverting input terminal of a comparator CP4 like the above comparator CP2 and is compared with a prescribed voltage Vb2 as a value which shows a prescribed amount of the throttle valve opening of the present invention. Then, an output of the result of this comparison is inverted and then is supplied to an AND gate G4 (hereinafter, an AND gate G4 say only a gate G4). An input signal of an input port IP4 is inverted and then is supplied to the gate G4.

Furthermore, the input signals of the input ports IP1 to IP4 are supplied to input ports IP5 to IP8 of the microcomputer 110 too, respectively. These input signals are used for the throttle control. Now, since the input signals of the input ports IP1 and IP3 are analog signals, these signals are supplied to the input ports IP5 and IP7 via A/D converters A1 and A2, respectively.

An output of the gate G1 is supplied to a base of a NPN transistor Tr4 via a resistance R22. A resistance R23 is connected between the base and an emitter of the transistor Tr4 and the emitter of the transistor Tr4 is earthed. A collector of the transistor Tr4 is connected with the electric source Vcc via a resistance R24 and is connected with a schmitt trigger circuit SMT via an integrating circuit comprising a resistance R25 and a condenser C3.

Furthermore, an output of the schmitt trigger circuit SMT, outputs of the gates G3 and G4 and an output of an output port OT2 of the microcomputer 110 are supplied to the OR gate G2 (hereinafter, the OR gate G2 say only the gate G2) and then an output of the gate G2 is supplied from the output port OT3 to the input port IN of the driver DR as shown in FIG. 6.

Figure 8:
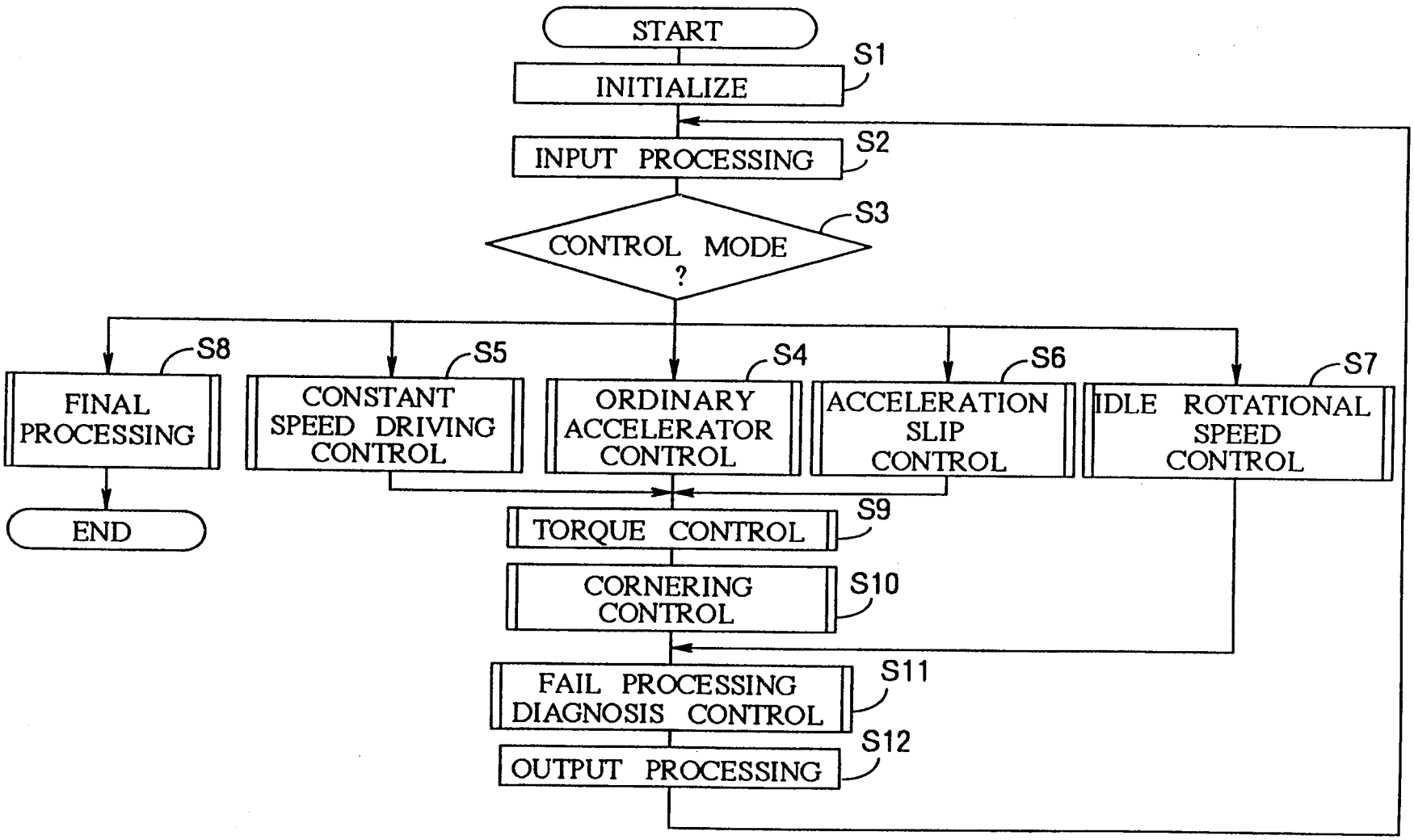
FIG. 8 is a flow-chart which shows a general operation of an embodiment of a throttle control apparatus in accordance with the present invention.

The above-described embodiment of the throttle control apparatus operates as follows. FIG. 8 is a flowchart which shows a general operation of this embodiment of a throttle control apparatus. In the controller 100, at first, an initialize is performed in step S1 and next the above-described various input signals which are supplied to the input processing circuit 120 are processed in step S2. Next, step 3 is performed and a control mode is selected in response to the input signals. Namely, one of steps S4–S8 is selected.

When the controls of the steps S4–S6 are performed (now, the ordinary accelerator control is performed in step S4, the constant speed driving control is performed in step S5 and the acceleration slip control is performed in step S6), a torque control and a cornering control are performed in step S9 and step S10, respectively. In the torque control, the throttle control is performed so as to reduce a shock which is generated in a variable speed operation. On the other hand, in the cornering control, the throttle control is performed in response to a steering angle of the steering (not shown). Now, since both controls are not directly related to this embodiment, explanation are omitted. Step S4 performs an idle rotational speed control and controls the throttle control apparatus so as to maintain the idle rotational speed even though the condition of the internal combustion engine changes. Step S8 performs an after-process after the ignition switch 101 became OFF. After the steps S7 and S10 were performed, respectively, a self-diagnosis is performed in step S11 by a diagnosis means and furthermore a fail-process is performed in step S11. Next, an output-process is performed in step S12 and the electromagnetic coil 20 and the motor 90 are driven via the output processing circuit 130. Thereafter, the above-described routine is repeated with a predetermined period.

Next, the operation of the ordinary accelerator control mode in the above general operation is explained. When the accelerator 7 is not operated, namely when the throttle valve 11 is fully closed, the clutch plate 40 is located at the side of the plate holder 50 by the urging force of the sheet springs 45 and is separated from the rotor 30.

When the electromagnetic coil 20 is applied an electric current and the yoke 21 and the rotor 30 are excited, the clutch plate 40 is attracted toward the rotor 30 and the first nail portions 35 and the second nail portions 41 are engaged with each other. A condition which is able to transmit the driving force of the motor 90 to the throttle shaft 12 is obtained. In this situation, since the pin 42 is moved with the clutch plate 40 toward the rotor 30, the notch 61 of the operation plate 60 is not engaged with the pin 42. Hereafter, except for abnormal conditions mentioned later, the throttle shaft 12 is rotated by the motor 90 and thereby the amount of the throttle valve 11 opening is controlled by the control of the motor 90 in the controller 100.

In the ordinary accelerator control mode, namely, when the depressing operation of the accelerator 7 is performed, an output signal of the accelerator sensor 8, namely an accelerator signal is supplied to the controller 100 in response to the operation amount and a target amount of the throttle valve opening is determined in the controller 100. Then, when the motor 90 is driven and the throttle shaft 12 is rotated, an output signal of the throttle sensor 13 is supplied to the controller 100 in response to the rotational angle of the throttle shaft 12 and the driving of the motor 90 is controlled by the controller 100 so as to nearly equalize the amount of the throttle valve 11 opening to the above target amount of the throttle valve opening. Thereby, the throttle control corresponding to the operation amount of the accelerator 7 is performed and the generating power of the engine which corresponds to the amount of the throttle valve 11 opening is obtained.

As mentioned above, the accelerator 7 is not mechanically connected with the throttle valve 11 and thereby it is able to obtain a smooth start and a smooth driving of the vehicle. Now, when the operation of the accelerator 7 is released, the throttle valve 11 is fully closed by the driving force of the motor 90 and the urging force of the return spring (not shown) which is disposed in the support 4.

In the above ordinary accelerator control mode, when the abnormal conditions of the accelerator sensor 8 or the throttle sensor 13, or an abnormal operation of the throttle valve 11 are detected by the judgment circuit DC as follows and either condition is judged as abnormality, the electric current being supplied to electromagnetic coil 20 is interrupted. Namely, in the judgment circuit DC, an accelerator abnormal signal is generated when the accelerator sensor 8 does not generate the accelerator signal corresponding to the operational amount of the accelerator operation mechanism and a throttle abnormal signal is generated when the throttle sensor 13 does not generate the throttle signal corresponding to the amount of the throttle valve 11 opening. Furthermore, a valve abnormal signal is generated when the throttle valve 11 became more than the prescribed amount of the throttle valve opening under the condition which the accelerator operational amount is less than the prescribed value. Thereby, a signal which interrupts the driving circuit of the electromagnetic coil 20 is generated when either of these three abnormal signals exists. Hereinafter, these details are explained on referring to flow-charts shown in FIG. 9 and FIG. 10 in order.

Figure 9:
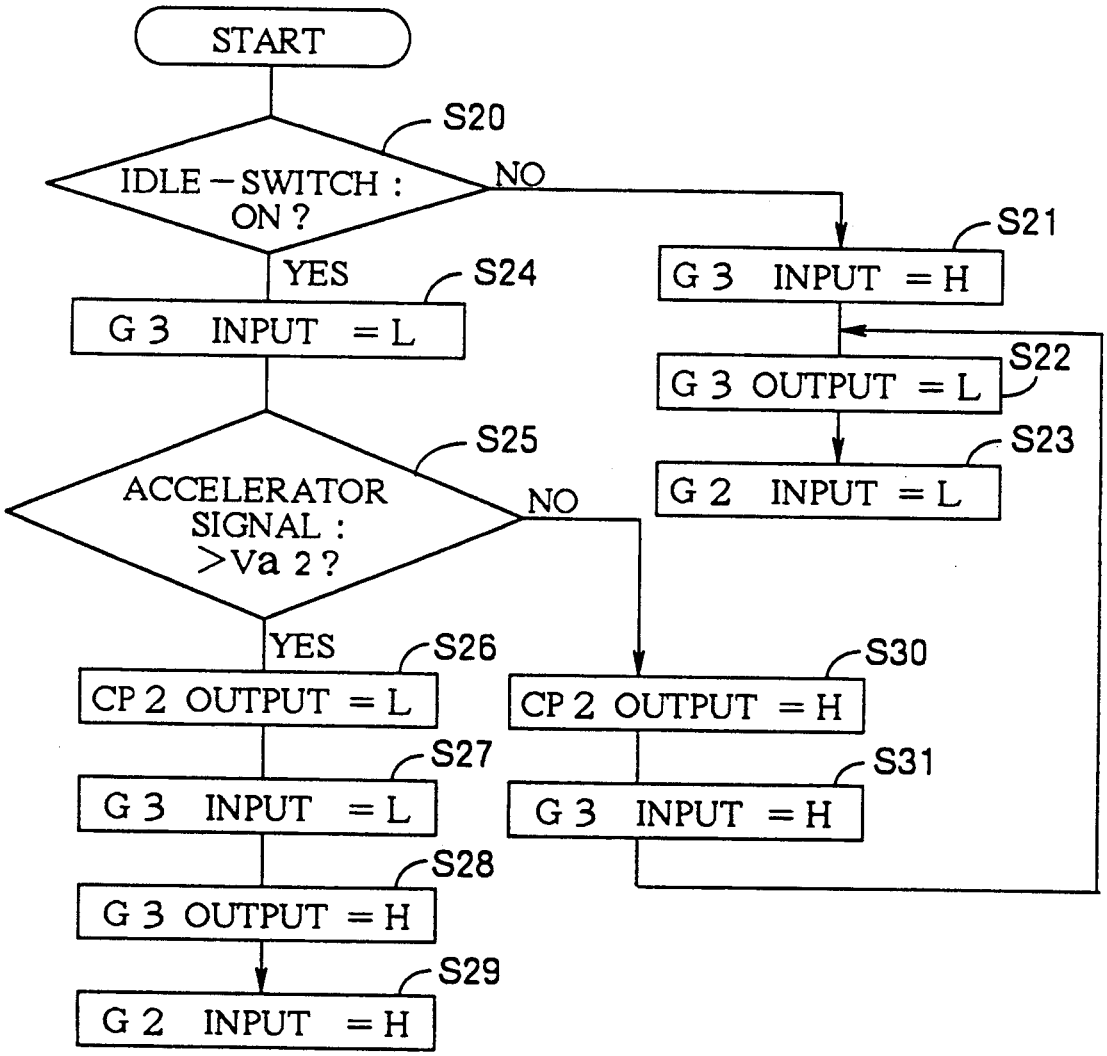
FIG. 9 is a flow-chart which shows an operation of the judgement circuit shown in FIG. 7; and, FIG. 10 is a flow-chart which shows an operation of the judgment circuit shown in FIG. 7.

First of all, a judgment of the operational condition of the accelerator sensor 8 is explained. Now, a judgment of the operational condition of the throttle sensor 13 is similarly performed too. Referring to FIG. 6, FIG. 7 and FIG. 9, when the driver is operating the accelerator 7, namely when the idle-switch SWa of the accelerator switch 8 is in the OFF condition, the transistor Tr3 is in the OFF condition and therefore the input signal of the input port IP2 is the high level (H) signal (step S21). Since this input signal is inverted by the inverting input terminal of the gate G3, the output signal of the gate G3 becomes the low level (L) signal certainly (step S22). Accordingly, the input signal of the gate G2 is the low level (L) signal (step S23) and the output siganl of the output port OT3 becomes the low level (L) signal. Therefore, the accelerator abnormal signal is not generated when the accelerator 7 is not positioned in the idle position.

When the operation of the accelerator 7 is released and then the idle-switch SWa becomes the ON condition, the input signal of the input port IP2 becomes the low level (L) signal and therefore the input signal of the gate G3 becomes the low level (L) signal (step S24). This input signal is inverted by the inverting input terminal of the gate G3 and therefore becomes the high level (H) signal. In this case, the condition of the output signal of the gate G3 is influenced by the condition of the input signal of the other inverting input terminal. Namely, the accelerator signal as the output of the accelerator sensor 8 is compared with the prescribed voltage Va2 in the comparator CP2 (step S25) and the output signal of the comparator CP2 becomes the low level (L) signal when the accelerator signal is more than the prescribed voltage Va2 (step S26). Then, this output signal is supplied to the inverting input terminal of the gate G3 (step S27). Accordingly, the output signal of the gate G3 becomes the high level (H) signal (step S28) and is supplied to the gate G2 as the accelerator abnormal signal (step S29). As mentioned above, when the accelerator signal is more than the prescribed value under the condition which the accelerator 7 is in the idle position, namely which the idle-switch SWa is the ON condition, the acclerator sensor 8 is judged as the abnormality.

Figure 10:
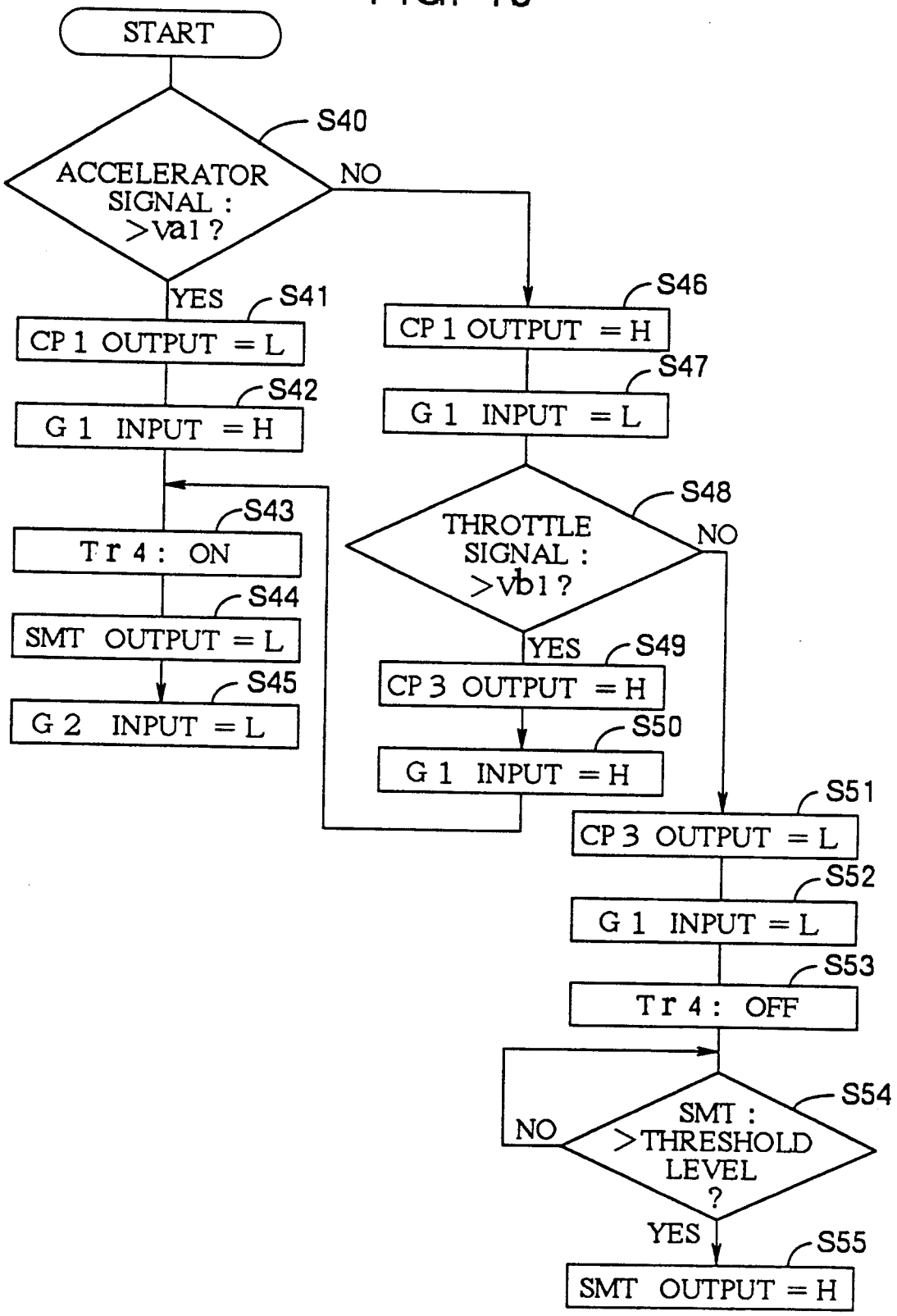

Next, a judgment of the operational condition of the throttle valve 11 is explained on referring to FIG. 6, FIG. 7 and FIG. 10. When the accelerator signal of the accelerator sensor 8 is more than the prescribed voltage Va1 (step S40), the output signal of the comparator CP1 becomes the low level (L) signal by the high level (H) input signal of the input port IP1 (step S41). Then, this output signal of the comparator CP1 is inverted by the inverter IV and is supplied to the gate G1 as the high level (H) input signal (step S42). Thereby, the output signal of the gate G1 becomes the high level (H) signal and therefore the transistor Tr4 becomes the ON condition (step S43). Accordingly, the input signal of the schmitt trigger circuit SMT becomes the low level (L) signal and therefore the output signal of the schmitt trigger circuit SMT becomes the low level (L) signal (step S44). Thus, the output signal of the schmitt trigger circuit SMT is kept low level (L) when the output signal of the accelerator sensor 8 is more than the prescribed voltage Va1 and therefore the input signal of the gate G2 is the low level (L) signal (step S45).

Furthermore, the condition of the throttle valve 11 under the condition which the accelerator 7 returned to the idle position is judged as follows. When the output signal of the accelerator sensor 8 is less than the prescribed voltage Va1 under the condition which the accelerator 7 returned to the idle position (step S40), the output signal of the comparator CP1 is the high level (H) signal (step S46) and the input signal of the gate G1 becomes the low level (L) signal (step S47). On the other hand, when the amount of throttle valve opening is less than the prescribed amount and the throttle signal of the throttle sensor 13 is less than the prescribed voltage Vb1 (step S48), the output signal of the comparator CP3 is the high level (H) signal (step S49) and the input signal of the gate G1 is the high level (H) signal (step S50). Therefore, the output signal of the schmitt trigger circuit SMT is kept low level (L) like the above mention (step S44).

When the throttle signal became more than the prescribed voltage Vb1, the output signal of the comparator CP3 becomes the low level (L) signal (step S51). Therefore, the input signal of the gate G1 becomes the low level (L) signal (step S52) and the transistor Tr4 becomes the OFF condition (step S53). Thereby, the condenser C3 is charged via the resistances R24 and R25 and the input signal of the schmitt trigger circuit SMT rises gently by these time constant. Then, when the input signal of the schmitt trigger circuit SMT becomes more than a threshold level of the schmitt trigger circuit SMT with a time lag Td (step S54), the output signal of the schmitt trigger circuit SMT becomes the high level (H) signal (step S55) and is supplied to the gate G2 as the valve abnormal signal. Now, the above time lag is proveded in order to avoid giving a judgment as the abnormality during time which are taken before the throttle valve 11 begins to close after the motor 90 is drived when the driver releases the acclerator 7 rapidly.

Thus, even though both the accelerator sensor 8 and the throttle sensor 13 are in normal condition, when the valve abnormal signal is supplied, the throttle control apparatus is judged as the abnormality. Eventually, the electric current is supplied to the electromagnetic coil 20 via the driver DR when each abnormal signal is not generated, namely when the output signal of the gate G2 is the low level (L) signal and the electric current being supplied to the electromagnetic coil 20 is stopped when the high level (H) signal showing at least one of three abnormal signals is generated.

When the electric current being supplied to the electromagnetic coil 20 is stopped, the clutch plate 40 is separated from the rotor 30 by the urging force of the sheet springs 45 and the throttle valve 11 is returned to its initial position by the return spring which is disposed in the support 4. Furthermore, the driving of the rotor 30 by the motor 90 is stopped too. In this situation, since the clutch plate 40 is moved toward the plate holder 50, the pin 42 is located between both surfaces 61*a* and 61*b* of the notch 61 of the operation plate 60. Accordingly, when the accelerator 7 is depressed more than a predetermined amount, the operation plate 60 is rotated and the surface 61*a* of the notch 61 is contacted with the pin 42. Therefore, hereafter it is able to directly transmit the operation force of the accelerator 7 by driver to the throttle shaft 12.

As mentioned above, according to this embodiment, the throttle control apparatus is constituted so as to be able to detect the abnormal operation of the throttle valve 11 by detecting the abnormalities of the accelerator sensor 8 and the throttle sensor 13 and by detecting the condition under which the amount of the throttle valve opening is more than the prescribed value when the accelerator operational amount is less than the prescribed value. Therefore, for example, it is able to avoid the situation which the operational condition of the throttle valve 11 is detected as normal by mistake by means of being canceled the abnormal conditions of the accelerator sensor 8 itself and the throttle sensor 13 itself. Furthermore, since it is able to constitute the judgment circuit DC by only the addition of an electric circuit regardless of the microcomputer 110, it is able to manufacture the judgment circuit DC easily and cheaply.

Next, an operation of the constant speed driving control of step S5 is explained. When the set switch ST becomes the ON condition after the main switch MS shown in FIG. 5 became the ON condition during the driving, a driving signal is supplied from the output port OT1 of the microcomputer 110 shown in FIG. 6 and the transistor Tr1 becomes the ON condition. Thereby, the electric current is supplied to the coil 23 and the clutch plate 40 is connected with the rotor 30. Now, in this situation, since the brake pedal (not shown) is not operated, the brake switch SW1 is kept ON condition.

Then, a target amount of the throttle valve opening is determined in response to a difference between the vehicle's speed which was detected by the wheel speed sensor 122 and a vehicle's speed which was set by the set switch ST of the constant speed driving switch 121 and the driving of the motor 90 is controlled by the controller 100 so that the throttle valve 11 maintains this target amount of the throttle valve opening. When the accelerator 7 is depressed for outrunning and so on during the constant speed driving and the amount of the throttle valve opening corresponding to the accelerator operational amount in the ordinary accelerator control mode exceeds the target amount of the throttle valve opening which the constant speed driving control mode was set, the constant speed driving control mode is changed to an overlaid mode and this target amount of the throttle valve opening is replaced with the amount of the throttle valve opening which is determined in the ordinary accelerator control mode.

When the constant speed driving control is released, the cancel switch CA of the control switch CS or a normal closed switch SC1 is operated by the driver and thereby the main switch MS becomes the OFF condition. Thereby, the transistor Tr1 shown in FIG. 6 becomes the OFF condition and therefore the electric current being supplied to the coil 23 is stopped. Now, in the same manner, when the ignition switch 101 becomes the OFF condition, the electric current being supplied to the coil 23 is stopped. Furthermore, when the brake pedal (not shown) is operated, the brake switch SW1 becomes the OFF condition and the electric current being supplied to the coil 23 is stopped. Hereinafter, the throttle control of the above mentioned ordinally accelerator control mode is performed via driver DR.

In the acceleration slip control of step S6, a slip of driving wheels is detected by the controller 100 at a starting time or an accelerating time in response to the output signal of the wheel speed sensor 122 shown in FIG. 5, the control mode is changed from the above described ordinary accelerator control mode to the accelerator slip control and the amount of the throttle valve 11 opening is controlled as follows.

Namely, in the controller 100, a slip ratio which can obtain a sufficient tractive force and a sufficient side reaction is calculated and furthermore a target amount of the throttle valve opening is calculated in order to maintain this slip ratio. Then, the driving of the motor 90 is controlled by the controller 100 so that the throttle valve 11 maintains the target amount of the throttle valve opening. When the slip rate becomes less than a predetermined value and the target amount of the throttle valve opening becomes more than the amount of the throttle valve opening determined in the ordinary accelerator control mode, the acceleration slip control mode ends and the control mode returns to the ordinary accelerator control mode.

In this situation, since the operation plate 60 and the pin 42 are engaged with each other in normal condition as mentioned above, even though the accelerator 7 is depressed more than the predetermined amount, a mechanically intervention is not generated in the control of the amount of the throttle valve opening by the motor 90. Accordingly, for example, when an acceleration slip is generated on road surface with low friction coefficient and the control mode changed to the acceleration slip control mode, even though the driver depresses the accelerator 7 large, it is able to fully close the throttle valve 11 by the motor 90. Therefore, it is able to perform the expected acceleration slip control and it is able to maintain the stable driving.

As described above, according to the present invention, the electromagnetic clutch mechanism is driven by the clutch control means so as to separate the driving source from the throttle shaft in response to each output of the accelerator abnormality detecting means, the throttle abnormality detecting means and the valve abnormality detecting means. Therefore, when either of the abnormalities of the accelerator operational amount detecting means and the throttle opening amount detecting means or when the abnormality of the operational condition of the throttle valve, for example, the condition which the operational amount of the accelerator operation mechanism is less than the prescribed accelerator operational amount and which the then amount of the throttle valve opening is more than the prescribed amount of the throttle valve opening, is detected, it is able to separate the driving source from the throttle shaft surely and it is able to stop controlling the throttle valve by the driving source at the same time.

Furthermore, according to the present invention, in the case of the throttle apparatus which the accelerator operational amount detecting means and the throttle opening amount detecting means are counstituted by the sensor and the switch, respectively, since it is able to constitute the above abnormality detecting means by only the addition of an electric circuit regardless of the driving control means, it is able to manufacture the above abnormality detecting means easily and cheaply.

The principles, preferred embodiment of the present invention have been described in the foregoing application. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in appended claims.

What is claimed:

1. A throttle control apparatus comprising;

an accelerator operation mechanism, a throttle shaft fixing a throttle valve of an internal combustion engine thereto and supported on a housing so as to be able to rotate, a driving source generating driving force in response to at least an operational amount of the accelerator operation mechanism and being able to drive the throttle schaft in the direction of opening and closing of the throttle valve, an electromagnetic clutch mechanism intermitting a connection between the throttle shaft and the driving source, driving control means for controlling the electromagnetic clutch mechanism intermittently and for controlling the drive of the driving source in response to at least the operation of the accelerator operation mechanism, accelerator operational amount detecting means for generating an output signal in response to the operational amount of the accelerator operation mechanism, accelerator abnormality detecting means for judging the operational condition of the accelerator operational amount detecting means on the basis of the output signal of the accelerator operational amount detecting means and for generating an accelerator abnormal signal when the abnormality of the accelerator operational amount detecting means is detected, throttle valve opening amount detecting means for generating an output signal in response to the amount of the throttle valve opening, throttle abnormality detecting means for judging the operational condition of the throttle valve opening amount detecting means on the basis of the output signal of the throttle valve opening amount detecting means and for generating a throttle abnormal signal when the abnormality of the throttle valve opening amount detecting means is detected, valve abnormality detecting means for judging the operational condition of the throttle valve in response to the output signals of the accelerator operational amount detecting means and the throttle opening amount detecting means and for generating a valve abnormal signal when the abnormality of the throttle valve is detected and clutch control means for driving the electromagnetic clutch mechanism in response to each output signal of the valve abnormality detecting means, the throttle abnormality detecting means and the accelerator abnormality detecting means so as to separate the driving source from the throttle shaft.

2. A throttle control apparatus as recited in claim 1, wherein the accelerator operational amount detecting means are provided with a first sensor which generates an accelerator signal corresponding to the accelerator operational amount of the accelerator operation mechanism and a first switch which changes to the ON condition or OFF condition in response to the operation of the accelerator operation mechanism and the accelerator abnormality detecting means generate the accelerator abnormal signal when the first switch is under the condition showing a nonoperational condition of the accelerator and when the accelerator signal of the first sensor shows a value which is more than a prescribed accelerator operational amount, and wherein the throttle opening amount detecting means are provided with a second sensor which generates a throttle signal corresponding to the amount of the throttle valve opening and a second switch which changes to the ON condition or OFF condition in response to the opening and closing of the throttle valve and the throttle abnormality detecting means generate the throttle abnormal signal when the second switch is under the condition showing a closed position of the throttle valve and when the throttle signal of the second sensor shows a value which is more than a prescribed amount of the throttle valve opening.

3. A throttle control apparatus as recited in claim 2, wherein the valve abnormality detecting means generate the valve abnormal signal when the accelerator signal shows a value which is less than a second prescribed accelerator operational amount and when the throttle signal shows a value which is more than a second prescribed amount of the throttle valve opening.

* * * * *